US009009883B2

(12) United States Patent
Chase et al.

(10) Patent No.: US 9,009,883 B2
(45) Date of Patent: Apr. 21, 2015

(54) BACKSPLASH WITH POT FILLER

(75) Inventors: Kevin M. Chase, Saint Joseph, MI (US); Gil A. Gaska, Saint Joseph, MI (US); Leif A. Norland, Saint Joseph, MI (US); Christopher J. Reinke, Saint Joesph, MI (US); Ameresh B. Viswanathan, Saint Joseph, MI (US); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1548 days.

(21) Appl. No.: 12/258,479

(22) Filed: Oct. 27, 2008

(65) Prior Publication Data

US 2010/0101018 A1 Apr. 29, 2010

(51) Int. Cl.
*A47K 1/00* (2006.01)
*E03C 1/05* (2006.01)

(52) U.S. Cl.
CPC ..... *E03C 1/055* (2013.01); *E03C 2201/40* (2013.01)

(58) Field of Classification Search
USPC ..... 4/644, 631, 626, 658, 653, 516; 137/551, 562, 552.7; 220/20, 639, 14; 126/1 R, 299 D, 5, 39 R
See application file for complete search history.

(56) References Cited

U.S. PATENT DOCUMENTS

| | | | | |
|---|---|---|---|---|
| 544,105 | A | 8/1895 | Madsen | |
| 2,620,785 | A * | 12/1952 | Zimmermann | 126/1 R |
| 3,762,440 | A | 10/1973 | Bryant | |
| 4,043,319 | A * | 8/1977 | Jensen | 126/299 D |
| 4,241,718 | A * | 12/1980 | Barnett | 126/21 R |
| 4,418,333 | A * | 11/1983 | Schwarzbach et al. | 340/310.11 |
| 4,441,002 | A * | 4/1984 | Teich et al. | 219/708 |
| 4,703,306 | A * | 10/1987 | Barritt | 340/310.18 |
| 5,915,851 | A * | 6/1999 | Wattrick et al. | 4/619 |
| 6,427,259 | B1 | 8/2002 | Cawthon | |
| 6,718,967 | B2 | 4/2004 | Luther | |
| 7,306,115 | B2 | 12/2007 | Beachy | |
| 2005/0235981 | A1 * | 10/2005 | Mac | 126/39 R |
| 2006/0005312 | A1 * | 1/2006 | Reddy et al. | 4/668 |
| 2006/0186215 | A1 * | 8/2006 | Logan | 236/12.2 |
| 2007/0226899 | A1 | 10/2007 | Pearson | |
| 2007/0246550 | A1 * | 10/2007 | Rodenbeck et al. | 236/12.11 |
| 2008/0277927 | A1 * | 11/2008 | Mueller et al. | 285/272 |

* cited by examiner

*Primary Examiner* — Lauren Crane

(57) ABSTRACT

A backsplash includes a faucet that provides point-of-use dispensing of water to a cooktop container. The backsplash includes controls that allow a user to select a desired amount of water to be dispensed, as well as the temperature of water to be dispensed. A filter assembly includes a replaceable filter that allows for filtered water dispensation. Optionally, the backsplash can be connected to one or more appliances in the kitchen in order to communicate information and/or power. The backsplash may also include a ventilation channel to direct vented air from a range to a ventilation shaft.

29 Claims, 9 Drawing Sheets

BACKSPLASH WITH POT FILLER

BACKGROUND OF THE INVENTION

1. Field of the Invention

The present invention pertains to the art of cooking and, more particularly, to a water dispensing backsplash for a cooktop.

2. Description of the Related Art

Typically, consumers must fill cooking pots with water from a faucet at a kitchen sink before transporting the filled pots to a cooktop for heating. Transporting heavy water filled pots to the cooktop can be problematic. Additionally, when recipes call for precise amounts of water, a consumer must measure out water from the faucet before adding the water to the cooking pot and transporting the pot to the cooktop.

In general, it is known in the art to provide a faucet and drain system adjacent a wok range in order to provide water for cooling woks during cooking, as demonstrated by U.S. Patent Application Publication No. 2005/0235981. However, this system is intended for use in a restaurant environment, and does not address the needs of a domestic cook. Therefore, there is seen to be a need for a system and method for supplying measured amounts of water to a cooking container on a cooktop.

SUMMARY OF THE INVENTION

The present invention is directed to a backsplash, which is separate from any appliance, for providing point-of-use dispensing of water to a cooking container. The backsplash includes a main body portion having a front wall with a faucet extending from the front wall. Controls on the backsplash allow a user to select a desired amount of water to be dispensed, as well as a temperature of the water to be dispensed. Water can be dispensed according to a desired volume of water, or may be dispensed according to a selected time period for dispensing. In a preferred form, the backsplash includes a controller, a smart valve for controlling the flow of water from the faucet, a filter assembly and a water inlet line. Various accessories may be included with the backsplash, including a light, a timer/alarm, an additive cartridge, a weight scale, an over-flow sensor, a shelf or a utility rail. A consumer can install the backsplash by simply attaching the water inlet line to a household cold water pipe, and plugging a power cord attached to the controller into a standard power outlet. Additional power cords allow a consumer to connect the backsplash to one or more appliances in order to share power and/or communication between the backsplash and the one or more appliances. In one embodiment, the main body portion includes a ventilation channel which is adapted to extend between the outlet of a range and the inlet of a ventilation shaft, such that air from the range is channeled through the backsplash and out through the ventilation shaft. Thus, the backsplash of the present invention provides convenient communication between appliances while allowing for direct dispensing of water to a cooking container supported on a cooktop below.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
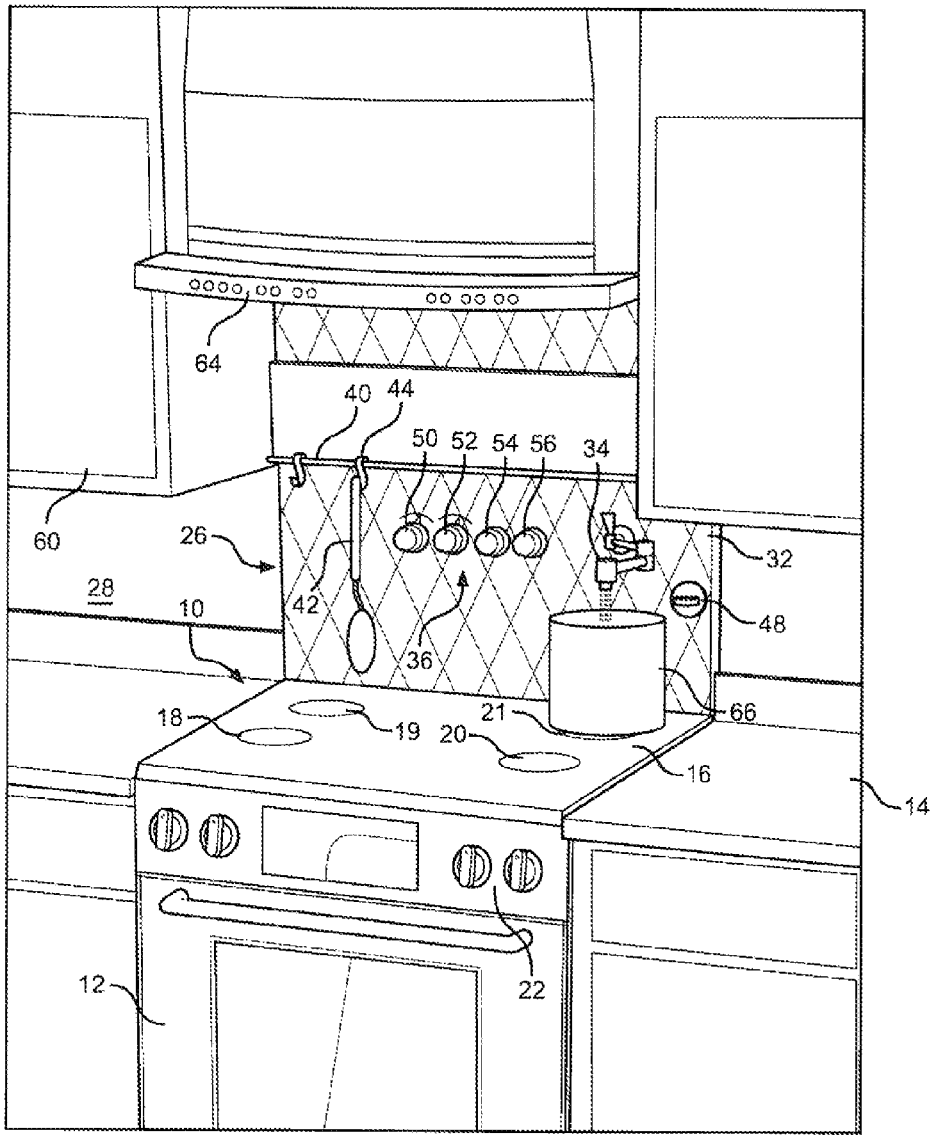
FIG. 1 is a perspective view of a backsplash of the present invention including a fold-out faucet configuration and a utensil rack.

With initial reference to FIG. 1, a kitchen arrangement is shown including a cooktop 10 provided atop an oven range 12 between countertops 14. Cooktop 10 includes a support surface 16, a plurality of heating element zones 18-21 and a control zone 22. Although cooktop 10 is depicted as including a ceramic cooking surface, heating element zones 18-21 could be defined by coiled-type heating elements or gas burners extending above support surface 16. In general, the present invention is directed a backsplash 26 for point-of-use water dispensing and is not intended to be limited by the type of cooktop 10 utilized with the invention.

As depicted, backsplash 26 is intended for use against a wall 28 above cooktop 10. Backsplash 26 includes a main body portion 32, a faucet 34 and a plurality of controls indicated at 36. In a first preferred embodiment depicted in FIG. 1, backsplash 26 also includes a utility rail 40 which can be utilized for hanging items from backsplash 26, such as a utensil 42 utilizing hooks 44. In the preferred embodiment shown, faucet 34 is in the form of a multi-hinged, fold-away faucet, which may be extended for use as shown or folded back against main body portion 32 when not in use.

In the first embodiment shown, controls 36 constitute manual dials including an actuating means or on/off dial 48, a selection means 50 for selecting the amount of water to be dispensed, a temperature control means or dial 52 for selecting the temperature of the water to be dispensed, a timer control 54, and a light control dial 56 for controlling a light, such as an under-hood light (not shown). Selection means 50 may be in the form of a volume control dial that allows a user to select a particular volume of water to be dispensed, such as a cup of water. Alternatively, selection means 50 may be in the form of a flow timer that allows a user to select a time period for water to dispense, such as 1 minute.

Backsplash 26 can be any desired height and width, but preferably extends along wall 28 from a point below cooktop 10 to the bottom of cabinets 60 or, as depicted in FIG. 1, to the bottom of an upper ventilation hood 64. Main body portion 32 is preferably fashioned from glass, stainless steel, enameled steel, porcelain or combinations thereof, and provides a washable surface. With this configuration, backsplash 26 of the present invention provides an attractive seamless look to the cooktop 10 and hood 64 arrangement, as well as providing a point-of-use water supply for a container 66 directly located on or adjacent cooktop 10.

Figure 2:
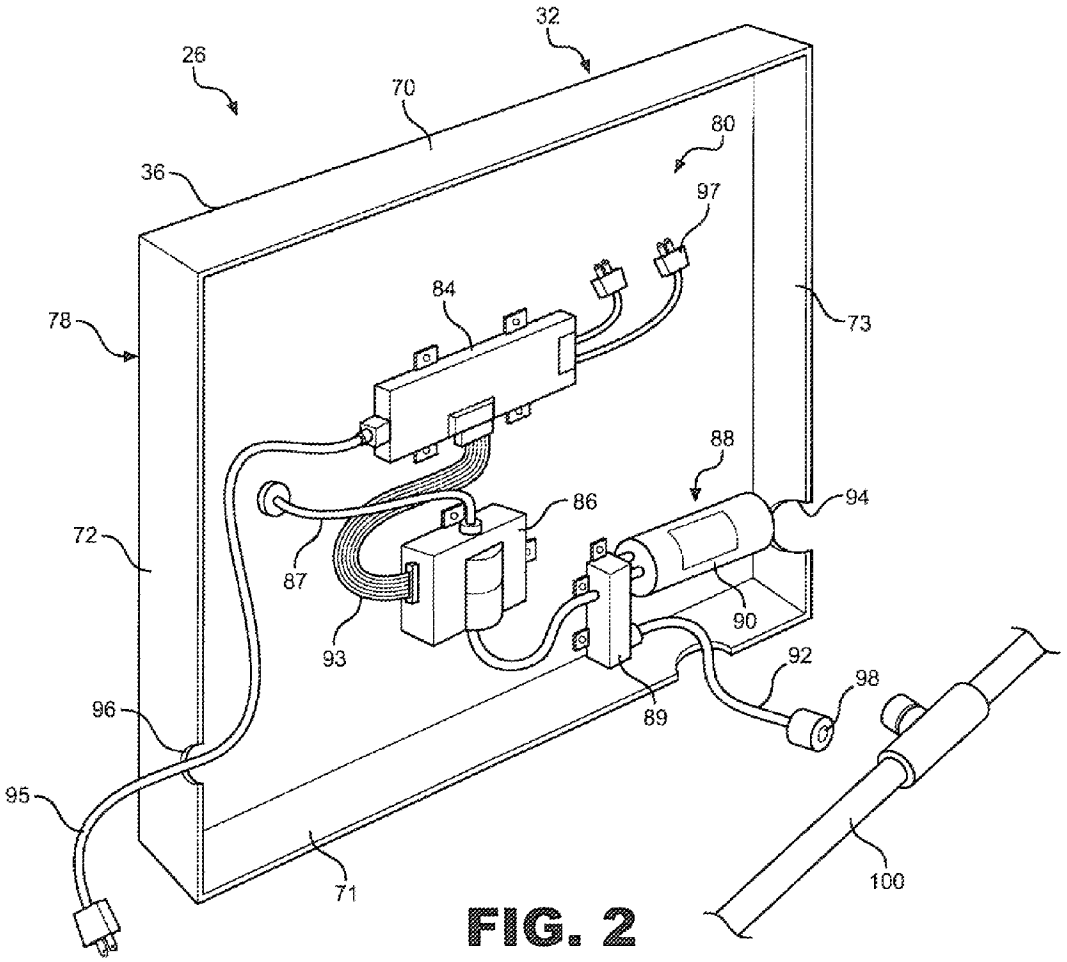
FIG. 2 is a rear perspective view of the backsplash of FIG. 1.

Advantageously, backsplash 26 is capable of being installed by a consumer, without the need for expensive professional installation services. With reference to FIG. 2, main body portion 32 of backsplash 26 includes front, top, bottom and opposing side walls 70-73, which define a housing 78 in which a plurality of components 80 are housed. In the embodiment shown, components 80 comprise a control board or controller 84, a smart valve 86 for controlling the flow of water to faucet 34 (depicted in FIG. 1) through a water supply line 87, a filter assembly 88 including a filter dock 89, a water filter 90, and a water inlet line 92. Control board 84 is connected to smart valve 86 via a flexible cable 93, and sends signals to smart valve 86 to control the flow of water to faucet 34 according to settings selected by a user through controls 36 (depicted in FIG. 1). Optionally, backsplash 26 may also be similarly connected to a hot water supply line (not shown), or may include a water heater (not shown) adapted to heat water prior to dispensing from faucet 34.

Preferably, side wall 73 includes a means for accessing filter assembly 88 for easy replacement of water filter 90, such as a cut-out portion 94. Optionally, backsplash 26 may also be adapted to include one or more additive cartridges (not shown) for dispensing additives through water supply line 87. A power cord 95 is adapted to plug into a standard outlet (not shown) to supply power to control board 84 and smart valve 86. Preferably, side wall 72 includes a cut-away portion 96 through which power cord 95 extends when backsplash 26 is mounted against a wall. Optionally, one or more additional power cords 97 may be utilized to communicate with or transfer power to air filters or light modules (not shown) or to another appliance such as ventilation hood 64 (depicted in FIG. 1), as will be discussed in more detail below. In accordance with the present invention, water inlet line 92 includes a quick-connector, such as copper tubing connector 98, adapted to connect water inlet line 92 to a cold water pipe indicated at 100. With this configuration, a consumer can install backsplash 26 by simply attaching water inlet line 92 to cold water pipe 100 through a single hole in wall 28 (not shown), and plugging power cord 95 into a nearby outlet.

Figure 3:
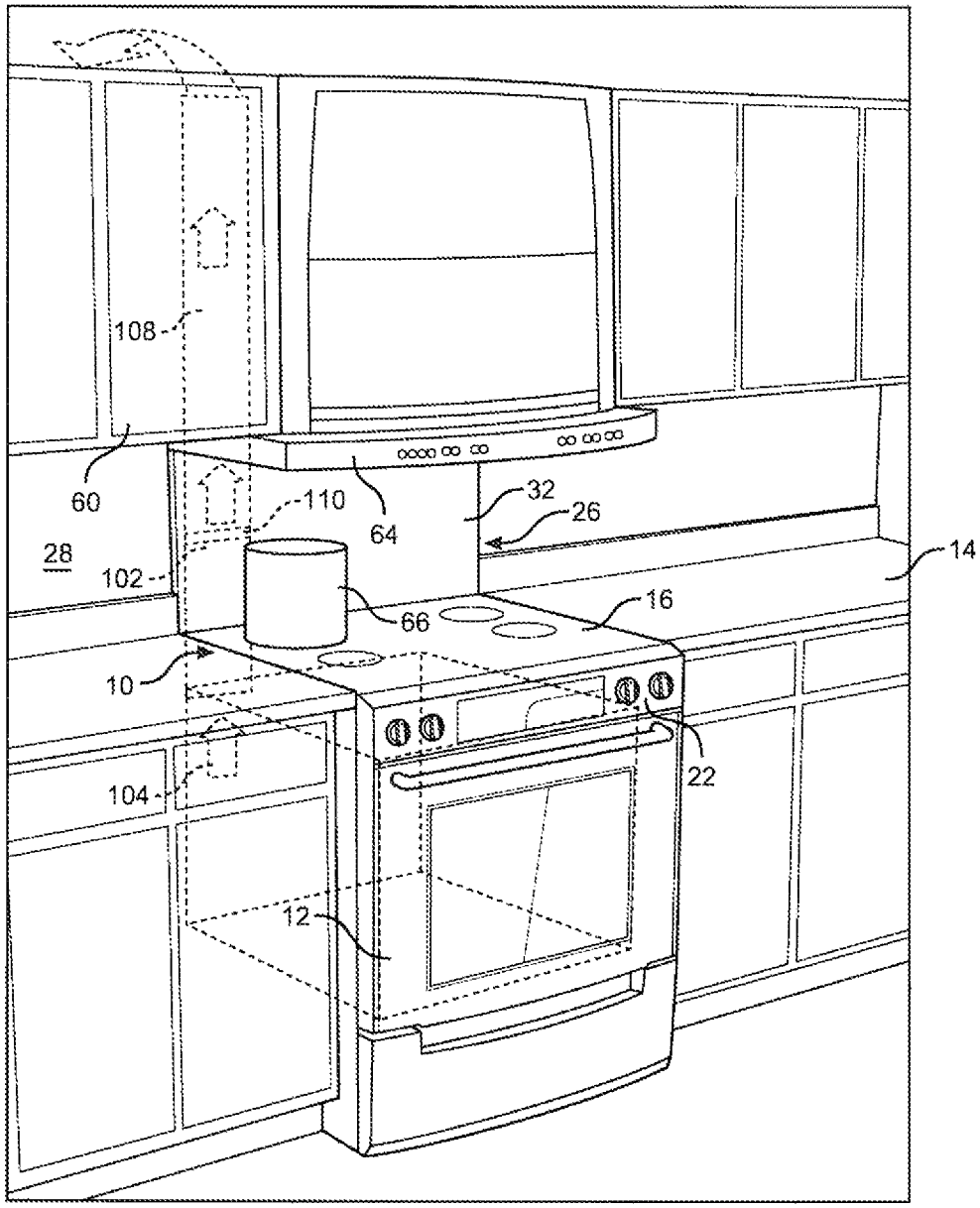
FIG. 3 is a schematic depiction of the backsplash of FIG. 1 including a ventilation pathway.

Optionally, components 80 may be positioned within housing 78 such that an air ventilation channel 102 may be incorporated into housing 78, as depicted in FIG. 3. Details including faucet 34 and controls 36 have been removed from FIG. 3 to aid in viewing. It should be understood that components 80 may be shifted as needed to adjust for the position of ventilation channel 102. More specifically, backsplash 26 may be positioned such that air ventilation channel 102 of backsplash 26 aligns with an air outlet 104 of a first appliance, such as range 12 and a ventilation shaft 108 within wall 28. Although only shown connected to range 12, it should be understood that ventilation channel 102 may be connected to other appliances instead of or in addition to range 12, such as a microwave hood (not shown). In this way, air ventilation channel 102 provides an attractive and seamless means for venting air from cooking appliances. Optionally, an air filter or air purifier indicated at 110 may be incorporated into ventilation channel 102. Advantageously, the undesirable heat and cooking smells from the vented air is prevented from entering the kitchen, providing an improved working condition for the user. Although not depicted, a vacuum suction means may also be incorporated into backsplash 26 in order to provide point-of-use cleaning.

Figure 4:
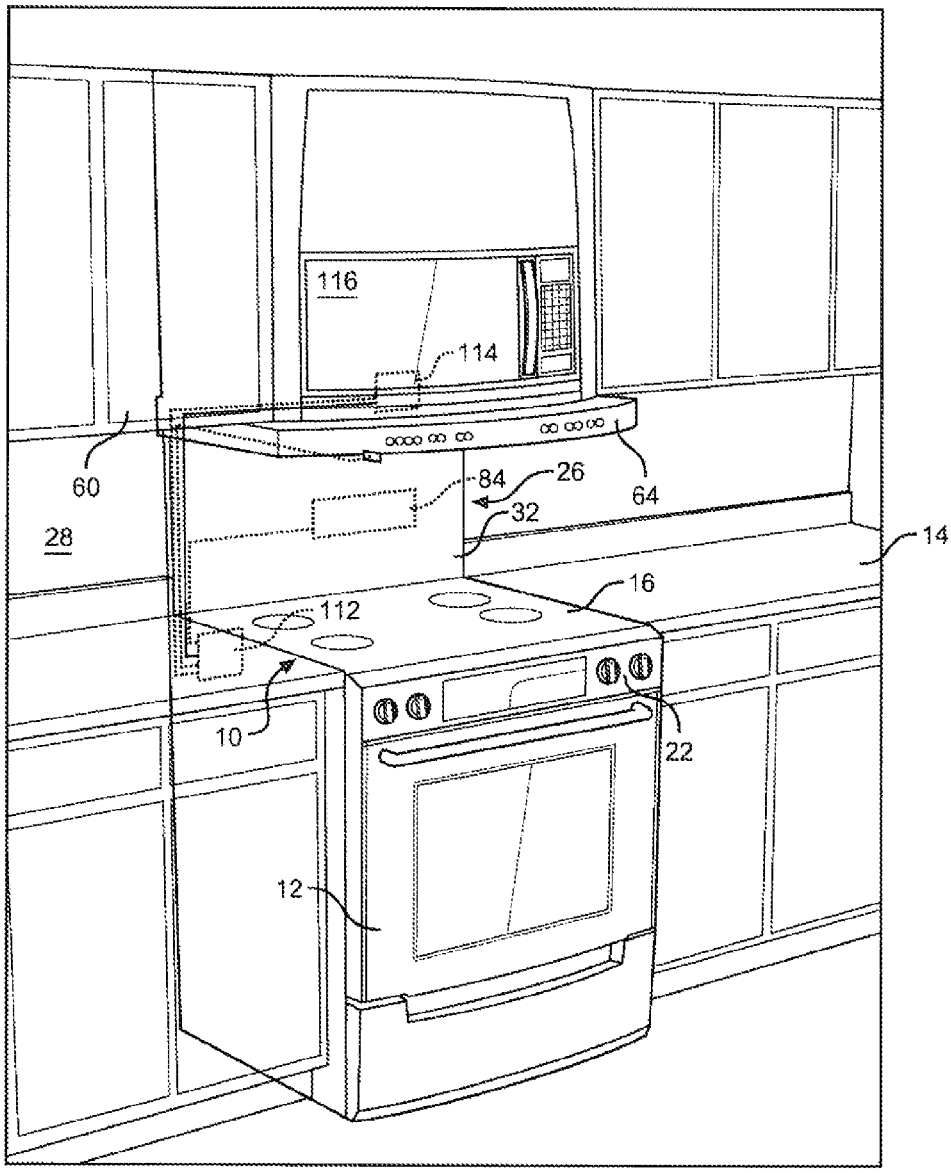
FIG. 4 is a schematic depiction of the backsplash of FIG. 1 in communication with a microwave oven and an oven range.

Yet another advantage of backsplash 26 is its ability to connect multiple appliances, such as a cooktop, range, microwave, ventilation hood and/or microwave hood. For instance, with reference to FIGS. 2 and 4, control board 84 of backsplash 26 may be connected via power cords 97 to controls 112 of a first appliance, such as range 12 and controls 114 of a second appliance, such as a microwave oven 116 or ventilation hood 64. Alternatively, a wireless communication means (not shown) may be utilized for communication between backsplash 26 and one or more appliances. At this point, it should be noted that details including faucet 34 and controls 36 have been removed from FIG. 4 to aid in viewing of other depicted structure. In any case, power cords 96 preferably function to share power and communications between appliances.

Although depicted as a hinged fold-out faucet in FIG. 1, it should be understood that faucet 34 could be a fixed faucet, a flip down faucet, a vertically sliding faucet, a pivoting faucet or another faucet configuration as will be discussed in more detail below. The faucets utilized may be commercially available models, or customized faucets. In a preferred embodiment backsplash 26 includes a faucet adaptor (not shown), which allows for the attachment of various makes and models of faucets to backsplash 26 to provide a customized look to backsplash 26. Further, backsplash 26 may be controlled utilizing dials, by utilizing a touch pad, by other well known control arrangements or by a combination of methods. In the alternative embodiment depicted in FIG. 5, for example, a backsplash indicated at 126 includes a flip-down faucet 128 and a control panel 130 having a touch pad 132 with a plurality of control buttons 134 for actuating a dispensing event and selecting the volume and temperature of water to be dispensed. A display 140 indicates information to a user, and preferably displays a count-down option wherein the time remaining until completion of a dispensing event is shown.

Figure 6:
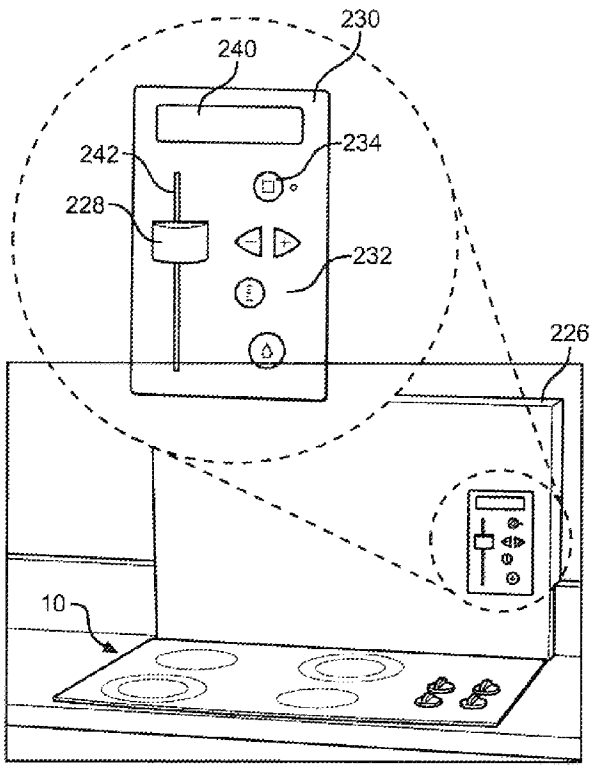
FIG. 6 depicts a second alternative backsplash arrangement with a vertical sliding spout.
Figure 5:
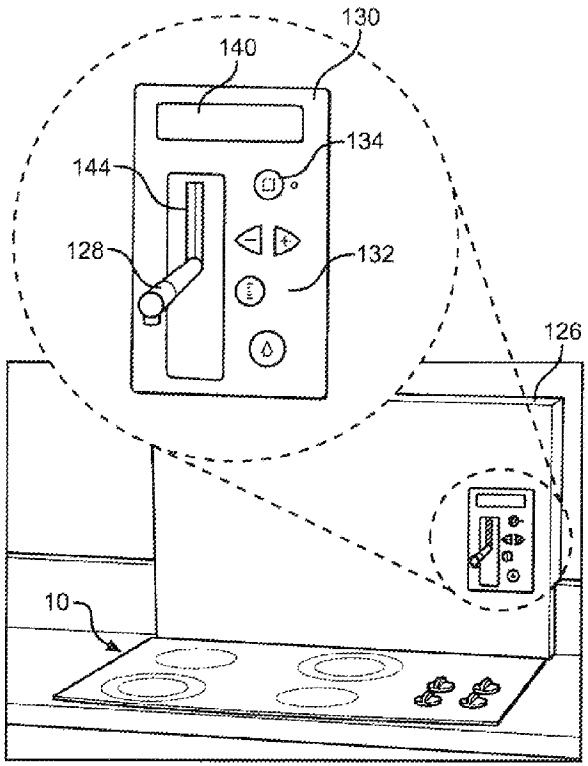
FIG. 5 depicts a first alternative backsplash arrangement with a flip-down faucet configuration.

When a user wishes to dispense water from a backsplash 126 into a container (not shown), a user begins by flipping down faucet 128 from a vertical storage position within a storage cavity 144 to a horizontal dispensing position as depicted in FIG. 5. Next, the user utilizes control panel 130 to dispense water from faucet 128 as desired. Preferably, the user has the option of setting a specific volume to be dispensed and a specific temperature of water to be dispensed before actuating a dispensing event. With this arrangement, heated water may be dispensed from faucet 128, thereby cutting down on the time necessary for cooktop 10 to heat water within a container. An alternative backsplash 226 depicted in FIG. 6 also includes a faucet or spout 228, a control panel 230 having a touch pad 232 with a plurality of control buttons 234 and a display 240. Backsplash 226 may be utilized in a similar manner to backsplash 126, with the exception that spout 228 does not flip down, but can be adjusted to a desired height level by sliding spout 228 along a vertical slot 242 before dispensing commences. With this configuration, it should be understood that the location of spout 228 can be adjusted by a user to accommodate a variety of container heights.

Figure 7:
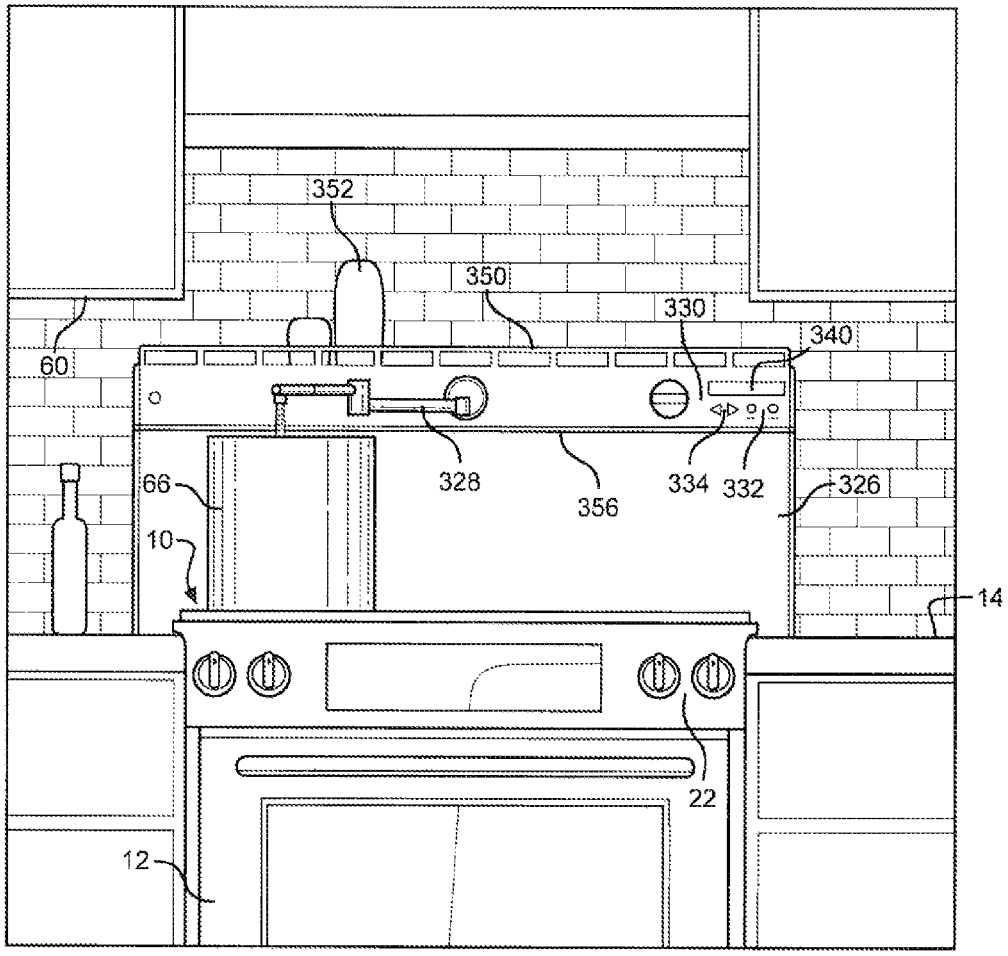
FIG. 7 is a front view of a third alternative backsplash arrangement including a utility shelf.
Figure 8:
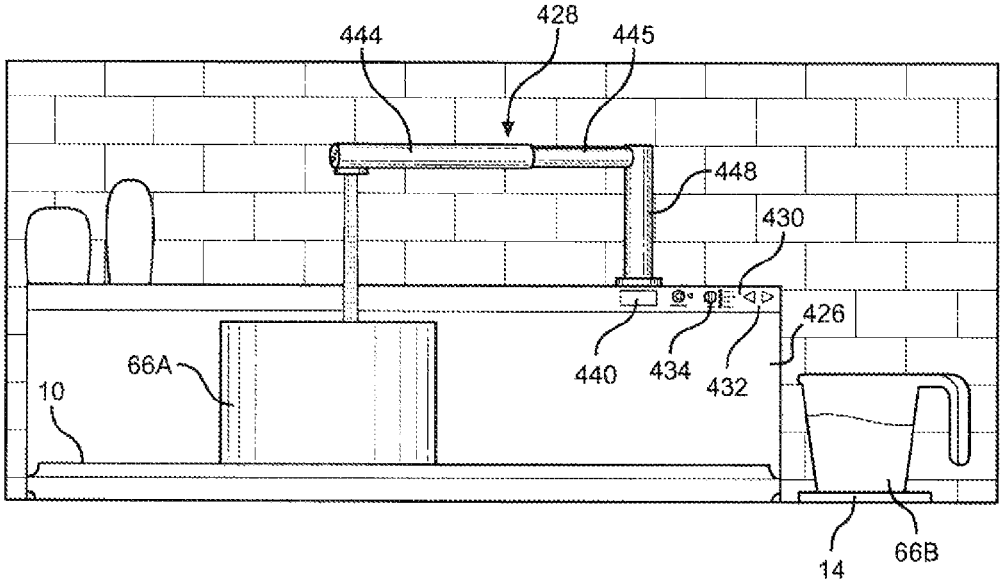
FIG. 8 is a front view of a fourth alternative backsplash arrangement including a top-mounted faucet.
Figure 9:
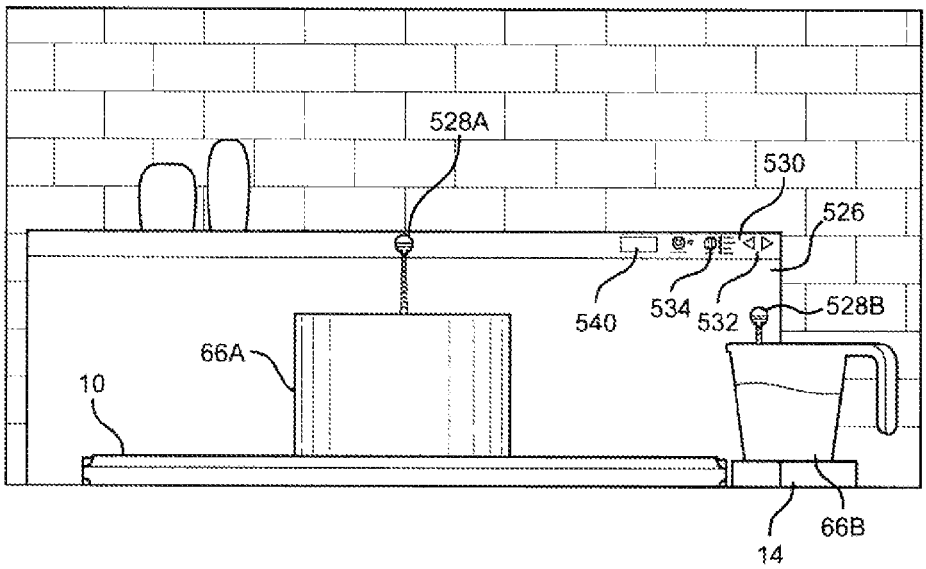
FIG. 9 is a front view of a fifth alternative backsplash arrangement including upper and lower stationary dispensers.

Another alternative embodiment is depicted in FIG. 7, wherein a backsplash 326 includes a faucet 328, a control panel 330 having a touch pad 332 with a plurality of controls 334 and a display 340. However, this alternative arrangement backsplash 326 also includes a utility shelf 350 incorporated at the top of backsplash 326 and adapted to hold a variety of products, such as spices 352. In a preferred embodiment, backsplash 326 also has an over-fill sensor indicated at 356 adapted to detect when a container such as 66 has been overfilled by faucet 328 or is boiling over. In a slightly different arrangement depicted in FIG. 8, a backsplash 426 includes a top-mounted faucet 428, a control panel 430 having a touch pad 432 with a plurality of controls 434 and a display 440. In this arrangement, top mounted faucet 428 includes a first outer arm portion 444 adapted to slide over an inner arm portion 445 such that outer arm portion 444 can extend horizontally from inner arm portion 445 as shown in FIG. 8, or outer arm portion 444 can be slid (retracted) over inner arm portion 445 to abut a support 448 when in a storage position (not shown). In this way, faucet 428 is adapted to extend to provide water to a first container 66A located on cooktop 10, or to a second container 66B located on an adjacent surface such as countertop 14. In yet another embodiment depicted in FIG. 9, a backsplash 526 includes a first upper stationary faucet 528A and a second lower side faucet 528B, a control panel 530 having a touch pad 532 with a plurality of controls 534 and a display 540. With this arrangement, backsplash 526 can be utilized to dispense water to first container 66A on cooktop 10 via faucet 528A, and/or can dispense water to second container 66B on countertop 14 via faucet 528B.

Figure 10:
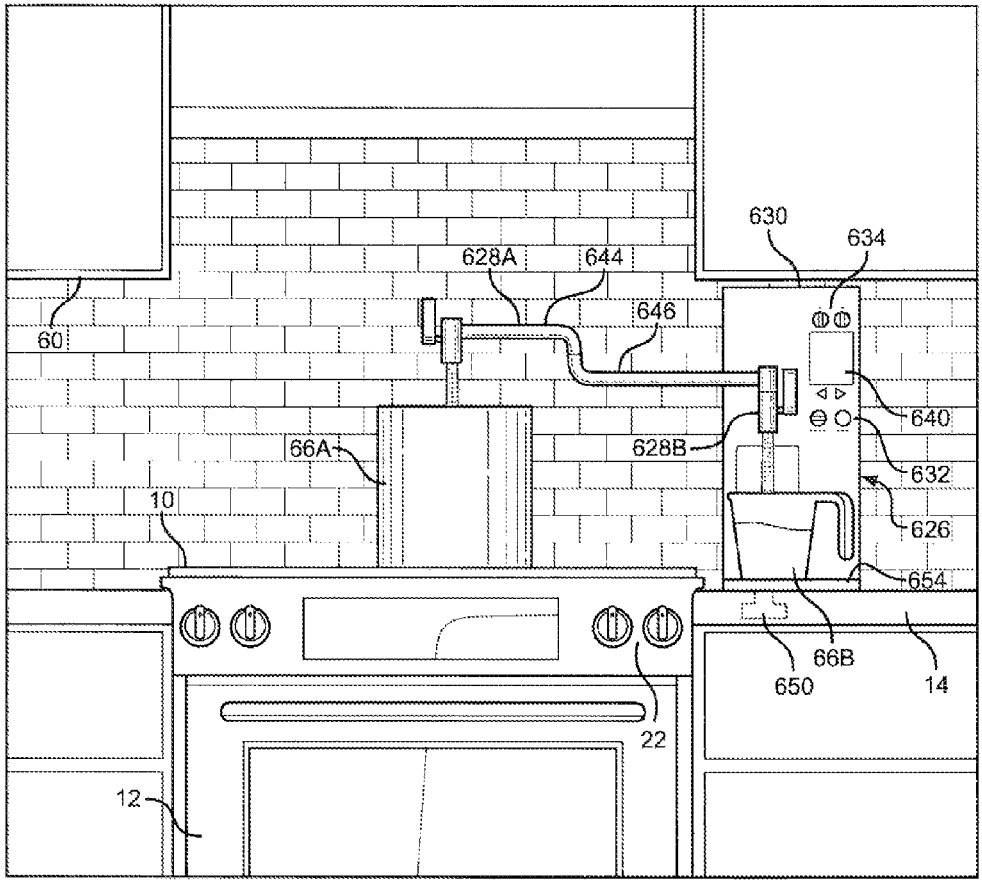
FIG. 10 is a front view of a side-mounted backsplash.
Figure 11:
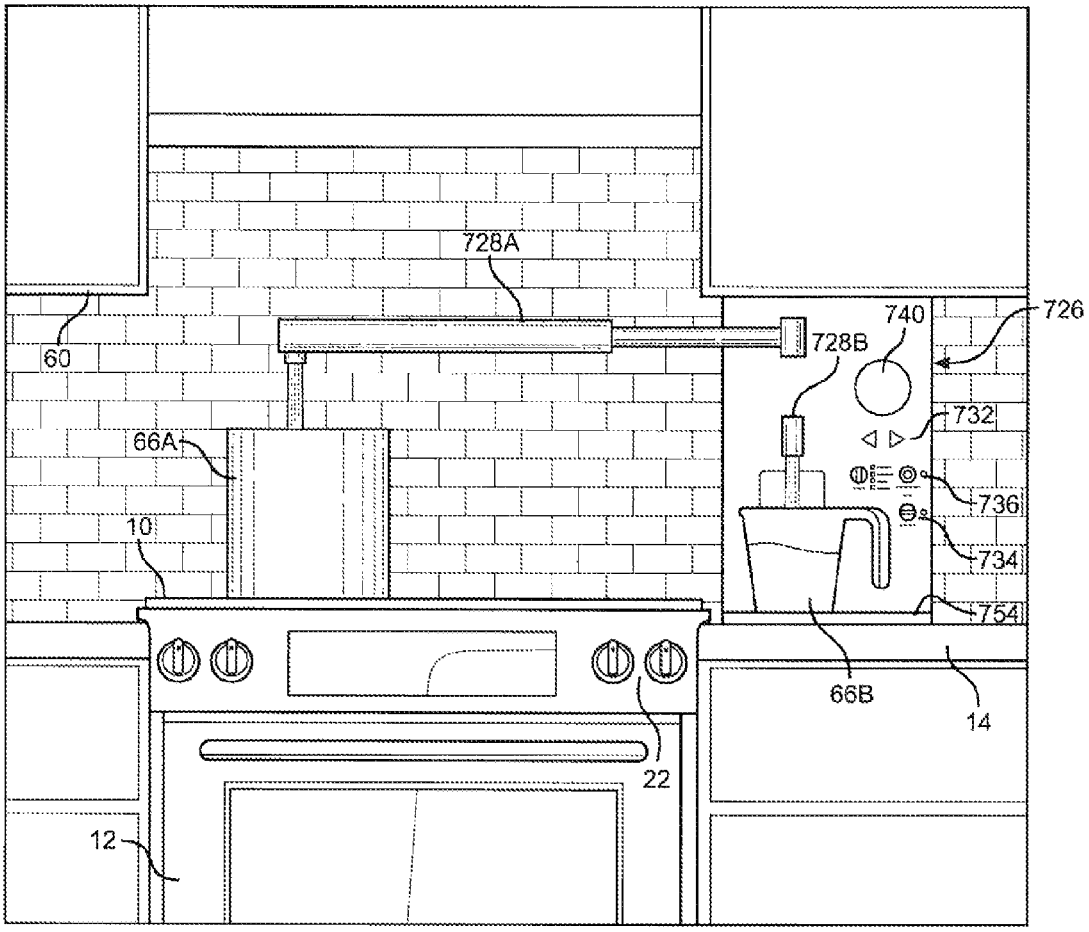
FIG. 11 is a front view of an alternative side-mounted backsplash according to the present invention.

Optionally, the backsplash of the present invention can be in the form of a smaller, side-mounted unit as depicted in FIGS. 10 and 11. With initial reference to FIG. 10, a side-mounted unit 626 includes a pivoting faucet 628A, a stationary faucet 628B, a control panel 630 having a touch pad 632 with a plurality of controls 634 and a display 640. Preferably, access to a water filter (not shown in FIG. 10) is provided through a port indicated at 650, below countertop 14. In the embodiment shown, side-mounted unit 626 also includes a weighing scale 654 for weighing liquids or solids. Preferably, scale 654 is in communication with side-mounted unit 626 and can be either integrally formed with, or separate from side-mounted unit 626. With this configuration, side-mounted unit 626 can be adapted to turn off a water supply from faucets 628A or 628B after a desired amount of water has been dispensed into container 66B on scale 654. Pivoting faucet 628A includes a first arm portion 644 pivotally attached to a second arm portion 646 such that first and second arm portions 644, 646 may be in a substantially U-shaped storage position (not shown) or in an extended position as shown in FIG. 10. With this configuration, water from faucet 628A may be dispensed to first container 66A on cooktop 10 when in an extended position, and when in a fold-away position water from faucet 628B may be dispensed to second container 66*b* located on countertop 14. A variation of this arrangement is shown in FIG. 11, wherein a side-mounted unit 726 includes a first extendable faucet 728A and a second stationary faucet 728B, a control panel 730 having a touch pad 732 with a plurality of controls 734 including associated indicator lights 736, and a display 740. In the preferred embodiment shown, side-mounted unit 726 also includes a weight scale 754 in communication with side-mounted unit 726.

Although described with reference to preferred embodiments of the invention, it should be readily understood that various changes and/or modifications can be made to the invention without departing from the spirit thereof. For instance, although depicted as being connected to a microwave oven and a range, it should be understood that the backsplash of the present invention could be connected to other appliances or to cabinetry. Further, it should be understood that the backsplash can be mounted either vertically or horizontally, depending on the desired use of the backsplash and can be customized to fit the needs of a particular customer. In general, the invention is only intended to be limited by the scope of the following claims.

What is claimed is:

1. A backsplash for point-of-use water dispensing comprising:

a main body portion including a housing having a washable, substantially planar front wall;

a faucet extending from the front wall of the housing for dispensing water;

a water supply line in fluid communication with the faucet;

a controller;

an actuating means for controlling the dispensing of water from the faucet; and a selection means enabling the selection of a desired amount of water to be dispensed from the faucet, wherein the backsplash is separate from any appliance and adapted to mount to and extend along a wall adjacent an appliance.

2. The backsplash of claim 1, further comprising: a smart valve between the water supply line and the faucet for controlling the flow of water from the water supply line to the faucet.

3. The backsplash of claim 1, wherein the selection means includes a volume selector for selecting a desired volume of water to be dispensed.

4. The backsplash of claim 1, wherein the selection means includes a time selector for selecting a desired time period for water to be dispensed.

5. The backsplash of claim 1, further comprising: a temperature selector for selecting a desired temperature of the water to be dispensed.

6. The backsplash of claim 1, further comprising: a water filter assembly including a water filter accessible by a user.

7. The backsplash of claim 1, wherein the front wall is comprised of a material selected from the group consisting of glass, stainless steel, enameled steel, porcelain and combinations thereof.

8. The backsplash of claim 1, further comprising: at least one of a utility rail, a timer, a shelf and combinations thereof.

9. The backsplash of claim 1, further comprising: a power supply cord adapted to plug into a household outlet.

10. The backsplash of claim 9, further comprising: an additional power cord extending from the controller and adapted to connect to another appliance.

11. The backsplash of claim 10, wherein the additional power cord is adapted to enable communication and the transfer of power between the backsplash and the appliance.

12. The backsplash of claim 11, wherein the appliance is selected from the group consisting of a cooktop, a range, a microwave, ventilation hood and a microwave hood.

13. The backsplash of claim 1, further comprising: a ventilation channel extending through the housing.

14. The backsplash of claim 13, further comprising an air filter within the ventilation channel.

15. The backsplash of claim 1, wherein the faucet is selected from the group consisting of a flip down faucet, an extendable faucet, a vertically adjustable faucet, a stationary faucet, a hinged fold-away faucet and combinations thereof.

16. The backsplash of claim 1, further comprising: a quick connector for connecting a water supply line to the backsplash.

17. The backsplash of claim 1, further comprising: a weight scale in communication with the backsplash.

18. The backsplash of claim 1, further comprising: an over-flow sensor.

19. A backsplash and appliance combination comprising:

an appliance;

a backsplash arranged behind the appliance for point-of use water dispensing comprising:

a main body portion including a housing having a washable, substantially planar front wall;

a faucet extending from the front wall of the housing for dispensing water;

a water supply line in fluid communication with the faucet;

a controller;

an actuating means for controlling the dispensing of water from the faucet; and a selection means enabling the selection of a desired amount of water to be dispensed from the faucet; and means for enabling communication between the appliance and the backsplash, wherein the backsplash is separate from the appliance and adapted to mount to and extend along a wall adjacent the appliance.

20. The backsplash and appliance combination of claim 19, further comprising:

means for enabling communication between a second appliance and the backsplash.

21. The backsplash and appliance combination of claim 19, wherein the means for enabling communication constitutes a power cord adapted to share power and communications between the controller of the backsplash and a controller of the appliance.

22. The backsplash and appliance combination of claim 19, wherein the appliance is selected from the group consisting of a cooktop, a range, a microwave, ventilation hood and a microwave hood.

23. The backsplash and appliance combination of claim 19, further comprising: a smart valve between the water supply line and the faucet for controlling the flow of water from the water supply line to the faucet.

24. The backsplash and appliance combination of claim 19, wherein the selection means includes a volume selector for selecting a desired volume of water to be dispensed.

25. The backsplash and appliance combination of claim 19, wherein the selection means includes a time selector for selecting a desired time period for water to be dispensed.

26. The backsplash and appliance combination of claim 19, further comprising: a temperature selector for selecting a desired temperature of the water to be dispensed.

27. The backsplash and appliance combination of claim 19, further comprising: a water filter assembly including a water filter accessible by a user.

28. The backsplash and appliance combination of claim 19, wherein the front wall is comprised of a material selected from the group consisting of glass, stainless steel, enameled steel, porcelain and combinations thereof.

29. The backsplash and appliance combination of claim 19, further comprising: a ventilation channel extending through the housing.

* * * * *